US009412237B2

(12) United States Patent
Barzilay et al.

(10) Patent No.: US 9,412,237 B2
(45) Date of Patent: Aug. 9, 2016

(54) ADAPTATION OF SKILL-BASED GAMES FOR TRAINING AND ENJOYMENT

(75) Inventors: Amos Barzilay, Los Altos, CA (US); Gabriel Zuniga, Los Altos, CA (US)

(73) Assignee: GAMOZ, INC., Los Altos, CA (US)

( * ) Notice: Subject to any disclaimer, the term of this patent is extended or adjusted under 35 U.S.C. 154(b) by 1055 days.

(21) Appl. No.: 13/538,885

(22) Filed: Jun. 29, 2012

(65) Prior Publication Data

US 2013/0005421 A1 Jan. 3, 2013

Related U.S. Application Data

(60) Provisional application No. 61/502,749, filed on Jun. 29, 2011.

(51) Int. Cl.
*A63F 9/24* (2006.01)
*G07F 17/32* (2006.01)

(52) U.S. Cl.
CPC ..... *G07F 17/3293* (2013.01); *G07F 17/32* (2013.01)

(58) Field of Classification Search
CPC .. G07F 17/3293; G07F 17/32; G07F 17/3237
See application file for complete search history.

(56) References Cited

U.S. PATENT DOCUMENTS 6,685,560 B1 * 2/2004 Hughes ..... G07F 17/32 463/16
6,749,500 B1 6/2004 Nelson et al.
2003/0109310 A1 6/2003 Heaton et al.
2003/0130023 A1 * 7/2003 Angel ..... G07F 17/32 463/13
2005/0020335 A1 * 1/2005 Weiss ..... G07F 17/3232 463/9
2007/0021206 A1 1/2007 Sunnen
2008/0118897 A1 * 5/2008 Perales ..... G09B 19/22 434/129
2008/0248851 A1 10/2008 Bloom
2008/0252011 A1 * 10/2008 Bickley ..... G07F 17/32 273/292
2008/0318651 A1 12/2008 Gross et al.
2009/0191934 A1 7/2009 Larson (Continued)

FOREIGN PATENT DOCUMENTS

CN 103781521 A 5/2014
EP 2726166 A1 5/2014

(Continued)

OTHER PUBLICATIONS

International Preliminary Report on Patentability for PCT/US2012/045089 dated Jan. 16, 2014.

(Continued)

*Primary Examiner* — Steve Rowland
(74) *Attorney, Agent, or Firm* — Nixon Peabody LLP; Joseph Bach, Esq.

(57) ABSTRACT

An electronic game wherein the user accumulates score which is based upon the appropriateness of the user's moves, regardless of whether the move resulted in a win or lose situation for the user. This approach provides the user with enjoyment of playing the game, but also focuses the user to learn how to make proper moves that would ultimately result in better skills in playing the game. One specific example relates to poker, wherein the user collects chips based upon winning or losing a hand, but at each decision round of playing the hand the user is awarded ProCoins based upon the appropriateness of the user's actions. The user is provided with feedback based upon the user's decisions, rather than based upon winning or losing a hand.

12 Claims, 9 Drawing Sheets

(56) References Cited

U.S. PATENT DOCUMENTS

| | | | | |
|---|---|---|---|---|
| 2011/0115159 | A1 * | 5/2011 | Baker | A63F 1/00 273/292 |
| 2011/0118009 | A1 | 5/2011 | Bone et al. | |

FOREIGN PATENT DOCUMENTS

| | | | |
|---|---|---|---|
| WO | WO 2004/022185 | A1 * | 3/2004 |
| WO | 2013/003799 | A1 | 1/2013 |

OTHER PUBLICATIONS

Extended Search Report for European Patent Application No. 12804226.4 dated Dec. 8, 2014.

Examination Report for European Patent Application No. 12804226.4 dated Feb. 23, 2015.

"Notification of Transmittal of the International Search Report and the Written Opinion of the International Searching Authority, or the Declaration," Date of mailing: Sep. 24, 2012, International Application No. PCT/US2012/045089, International Filing Date: Jun. 29, 2012, pp. 1-9.

* cited by examiner

ADAPTATION OF SKILL-BASED GAMES FOR TRAINING AND ENJOYMENT

RELATED APPLICATIONS

This application claims priority benefit from U.S. Provisional Application No. 61/502,749, filed Jun. 29, 2011, the disclosure of which is incorporated herein by reference in its entirety.

BACKGROUND

1. Field

This application relates to the field of electronic games and, more specifically, to the adaptation of games that are based on players' decisions in a manner that provides enjoyment and training.

2. Related Art

Various games are designed to progress, or are scored, based on player's analytical decisions, rather than player's motor skills. Examples of such games include poker and other card games, casino games, backgammon, chess and other strategy games. Such games may have a component of chance, but player's decisions may dictate the long-term outcome. Also, the player's decision may depend not only on the game pieces and status, but also on knowledge of the character, e.g., extrovert, risk averse, etc., of the opponents in the game. In some cases, the player's actions may also depend on the player's knowledge of how the opponents perceive the player.

Casino games such as five, seven, nine card poker, paigow poker, Texas hold'em, etc. require a player to provide continuous input into the game. Poker games are considered by some to be chance-based games, i.e., a player may lose a poker game although the player exhibits skill by making all the correct decisions with respect to the cards dealt to the player. On the other hand, a player may win a poker game even though the player made unwise decisions by virtue of the cards held by the player. For example, consider two players Alice and Bob involved in a Texas hold'em poker game. Alice is dealt a pair of aces (AA) and Bob is dealt a pair of kings (KK). The community cards are 2-3-4-Q-K. Alice bets a thousand chips with AA. Bob calls the thousand chips bet by Alice. Alice played perfectly as AA is over a 4:1 favorite to win, yet lost, some would say because of luck. However, the outcome of the game could have also depend on the character of Alice and Bob, and the way each player perceives the character of the other, as poker is also a "mind" game. For example, if Bob is a guy who mostly plays solid hands while Alice plays loose, since Bob has a solid hand, he may try to draw Alice in by raising the stakes, thus winning more chips on the same hand. Conversely, if Alice believes that Bob is a conservative player, Alice may try to have him fold by raising high, thereby winning with inferior hand. That is, the player's decision making based on the "human" aspect of the game can change the ultimate outcome, i.e., how many chips the player won or lost, regardless of the number of hands the player won or lost.

Introducing a skill component and proper decision making into such games has been suggested in the art. According to one example, a skill component is introduced into the poker game by evaluating each player of the poker game for correct play. A player is said to exhibit correct play if, regardless of the cards held by the player, the player makes the opponents fold. Expected value for each player is calculated based on bets placed by each of the players, probabilities of winning the poker game by the players, and the sum of bets placed by the players. On calculating the expected value for each player, the players are awarded a predefined percentage of the bets placed as an incentive for correct play. The predefined percentage of the bets placed may be awarded to the players as skill chips. The poker game may continue for a predefined time or until one player has all the chips. Since some chips can only be won by skill, and it takes all chips to win or lose the poker game, the outcome of the poker game is dependent on playing skills of the players. See, e.g., U.S. Patent Application Publication no. 2009-0191934.

The "human" or skill factor is also addressed in U.S. Patent Publication no. 2008-0248851. Describing a televised poker game, it explains that the player's hole cards are typically displayed on the screen, along with a calculated percentage chance that he will win the hand. As subsequent cards are dealt, these percentages are updated. Specifically, to the issue of skill rather than chance, the '851 Application describes that the announcer can then observe, "John bluffed Greg and got Greg to fold a hand that was a three to one favorite to win, what an aggressive move!" or "John took a really 'bad beat' in that hand because Greg's 'miracle card' got dealt, allowing Greg to win the hand even though John was a 20:1 favorite to win."

Such viewing or playing can be enhanced by providing additional statistical information regarding the strength of a player's cards and a player's strategy. The concept of poker chance and skill scores may be used by formulas which provide a quantitative index as to how lucky or skillful a player has been over a given period of time. The '851 Application explains that there are many intuitive and practical advantages to calculating the luck and skill scores. First, the luck and skill scores are calculated using information which is already displayed to the poker television viewer: percentage chance of winning, pot size, and amount each player is putting in the pot. Second, the scores give mathematical validity to the intuitive concept that a skilled poker player will "get his money in with the best of it"; in other words, increase the pot size when he is statistically favored to win. When a player holding the worse hand bluffs another player out of a pot, this is reflected positively in the bluffer's skill score and negatively in the loser's skill score. When a player "sucks out" on the river, this is reflected positively in his luck score and negatively in his opponent's luck score. A final advantage to calculating luck and skill scores in this way is that knowledge of the board cards that would have been dealt had players stayed in the hand until showdown is not required. If a player folds before the flop, for example, whether or not he would have had the best hand on the river does not affect his luck or skill scores.

One major limitation of the above approaches is that they mostly do not reflect how poker is really played. A large part of poker (and other similar games) is anticipating how opponents react to a player's moves. A player's actions in poker depend on how the player views the character of his opponents, and on how the opponents view the player. These variables have nothing to do with the cards themselves, but are rather acquired "people reading" skills. The more a player knows how to "read" his opponents, the more the player can learn to take advantage of this skill. Conversely, the more a player knows how to make opponents "read" him wrongly, the more the player can take advantage of that skill.

Players today are exposed to various methods of plays, as shown in different TV programs and books, and there are various "common wisdoms" related to poker. For example, when a UTG (Under The Gun, i.e., the player who has to move first after cards are dealt) player raises 3× and the player after him raises 4×, it indicates the second raiser has a monster hand. Most good players learn the statistics behind poker relatively early. The poker experts of today are skillful in reading the scenarios created at the table and manipulating their opponents to make mistakes, such as folding stronger hands or betting/calling weaker hands. Most poker players are eager to learn these skills. These skills cannot be taught purely by probability, statistical algorithms, etc., particularly in the case of multi-player, no limit game.

With the growing popularity of smartphones, such as iPhone, Android-based phones, etc., many games, including poker games, are available for download. One common thread of successful games, such as Angry Birds, Poker by Zynga, etc., is that users don't have to dedicate much time and thinking to play the game. The player can be interrupted by phone call, SMS message, email, etc., at any time, without adverse effect for the user. For example, in Poker by Zynga, the user can purchase chips that may last for a week or a month of gaming, at very low, almost symbolic, price. Consequently, losing a hand at the game is of no material consequences to the user. Therefore, it is immaterial that the user does not know the other players at the table and has spent no time learning their character. The user can join a table at any time, play a few hands, and leave the table upon an interruption, with the difference between winning and losing being inconsequential. While such plays are fun, for those players who would like to take the game more seriously and play at higher level and at higher stakes, learning how to play a hand properly, taking the other players' character into account, can be very important. However, the problem is that most users of games on mobile devices would prefer not to spend too much time studying opponents, and require game application that allows for interruptions without adverse effect.

SUMMARY

The following summary of the invention is included in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

Aspects of the disclosed invention provide a teaching mechanism that helps the player learn and hone their skills in the game. The user is able to learn and advance at the user's chosen time and pace, and can stop at any time due to interruptions or otherwise. Embodiments can be implemented on smartphones, laptop, game consoles, dedicated devices, etc.

According to disclosed aspects, the teaching is done not using statistical or other computational algorithm, but rather using experts' knowledge. Therefore, disclosed embodiments are particularly suitable for games wherein opponents' character and studied behavior are important for the user's decision making, such as in poker.

According to yet other disclosed aspects, the game progresses with the user winning or losing chips, as in prior art games, but in addition the user collects points according to moves the user decided to take. The collected points are separate and independent from the chips. For example, in one play the user may make a good move, but nevertheless lose the hand, perhaps due to bad luck. Under such situation, the user will lose chips, but will be rewarded with points, so as to encourage and enhance proper decision making Conversely, on another hand the user may make an inappropriate move, but nevertheless win the round due to chance. Under such condition, the user would win chips, but would not be rewarded with points, so as to discourage such wrong decisions. The goal of the game; however, is to collect points not chips. That is, the player is ranked according to the collected points, not according to the winning of chips. In this manner, the teaching of proper plays is enhanced separately from the win/lose status of the game.

In fact, according to some embodiments, the winning of chips is actually pre-programmed into each hand. That is, in such embodiments, an expert authors the hands to be played by a user. The author programs the virtual opponents and their characters, the cards dealt, the moves the virtual opponents would make, and pre-programs a limited number of actions the user may select from. The expert ascribes to each pre-programmed action a value, and selects one action as being the best. In some embodiments, regardless of the user's choice, the game proceeds with the author's selected best option, such that the chips won/lost at each hand are really preprogrammed beforehand according to the "best" choices programmed by the expert. Thus, in effect, the player's winning or losing of chips is preprogrammed beforehand and the player cannot change it. Moreover, the number of chips won/lost is independent for each hand, such that each hand may start with different stacks for the user and the virtual opponents. Conversely, the skill score is awarded according to the choices made by the user and is cumulative over the hands played. Thus, the scoring is really only of the user's skills, and does not involve any element of chance. Since only the skill scoring is cumulative, the goal of the game becomes collecting skill points, rather than chips.

According to aspect of the disclosure, a computerized method for running a game that has a combination of chance and skill, while enhancing the user's skill level, is provided. When executed by a computing device, the method causes the computing device to perform the operations: configure and operate progression of the game; display the game on a monitor; simulate opponents and actions of the opponents; display distribution of tokens based on the user's and opponents' winning or losing situation; and perform scoring based on the user's actions at each decision round of the game, separately and independently of the winning or losing situation. The operation of simulating the actions of the opponents may be performed according to list of actions pre-programmed by a human author. The method further may implement an operation of presenting the user with a limited number of actions at each decision round of the game. The operation of simulating opponents may comprise presenting the user with trait information about each simulated opponent, wherein the trait correlates to simulated decision making of the opponent. The operation of simulating opponents may further comprise presenting an icon on the monitor whenever a simulated opponent's trait is specifically relevant to the game round being played. The method may further comprise ascribing character trait to the user and presenting on the monitor an indication of the character trait of the user. The operation of simulating opponents' actions of the opponents may comprise fetching from storage memory pre-programmed opponents and pre-programmed actions of the opponents. The user may receive privileges based upon the secondary scoring.

According to further aspect, an electronic poker game system is provided, comprising: an authoring modules and a game module. The authoring module presents an author with tools to pre-program a hand to be played by a user on the game module, the pre-program comprising: a setting of a scenario, virtual opponents and assigned character traits of each virtual opponent, actions each of the virtual opponents make at each round, a limited number of alternative actions the user may select from at each round, and a scoring corresponding to each of the alternative actions. The game module presents the user with a poker game using the pre-program of the author and maintains the scoring according to user's selections from the alternative actions. The game module stores a plurality of hand packs, each hand pack comprising a plurality of different hands pre-programmed by authors.

The authoring module further enables the author to pre-program a character trait for the user corresponding to the manner in which the virtual opponents view the user. According to one embodiment, the game module maintains: initial scoring, corresponding to scoring achieved by the user upon playing a hand pack for the first time; current scoring, corresponding to scoring achieved by the user by currently playing the hand pack; and best scoring, corresponding to the best scoring achieved by the user by playing the hand pack. The game module presents the user with privileges based upon the scoring. The privileges may include providing the user with new hand pack, wherein a hand pack comprises a plurality of different pre-programmed hands. The pre-program may further comprise storing selections of cards dealt to each of the virtualized opponents and the user, and at pre-flop, flop, turn and river stages. The limited number of alternative actions may be selected by the author from a larger list of available actions. The game module may progress the game according to the best of the alternative actions, or according to any action determined by the author, regardless of the user's selections from the alternative actions.

Other aspects and features of the invention will become apparent from the description of various embodiments described herein, and which come within the scope and spirit of the invention as claimed in the appended claims.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

FIG. 7A illustrates a screenshot of an authoring tool, enabling an expert to author, edit, and test hands, while

DETAILED DESCRIPTION

Figure 1:
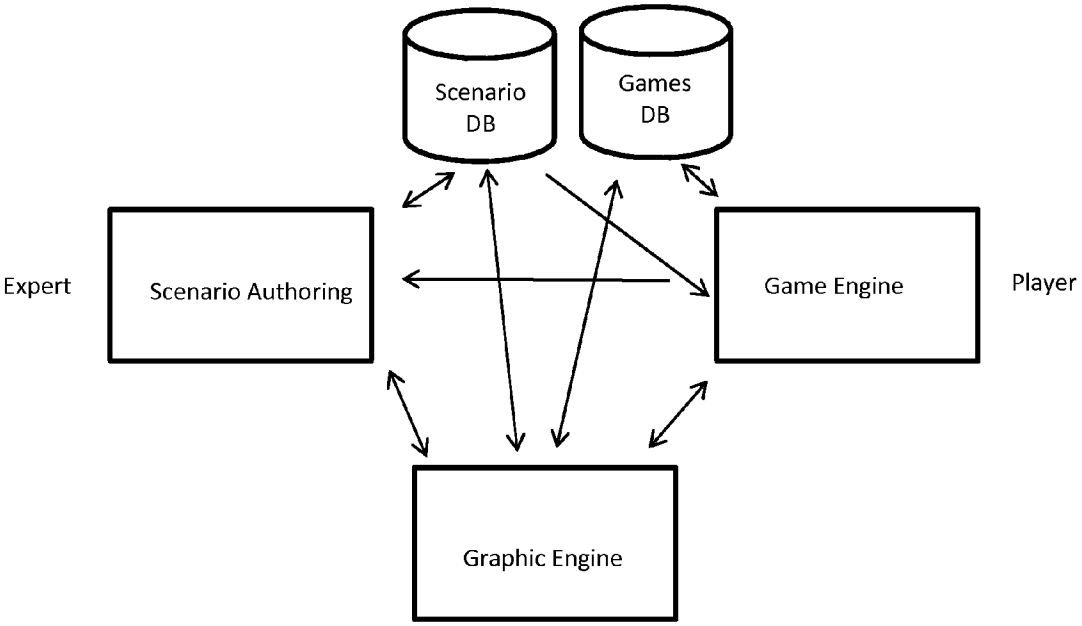
FIG. 1 is a block diagram illustrating major conceptual components according to one embodiment of the invention.

This invention uses a fundamentally different approach than has been previously taken in the prior art. According to one embodiment, the apparatus, systems and methods of the invention evaluate the player's skill exactly as a human expert would evaluate it, watching the player's move, as if the expert is standing behind his shoulder in real time. Every scenario experienced by player has been previously analyzed by a human expert. Therefore, the apparatus has the means, at the time a game is crafted, to present each possible scenario that a player may face to a human poker expert and to capture the human expert's evaluation for every possible decision the player might make. During play time, the apparatus presents the identical scenario to the player, captures the player's decision, and scores the player's decision purely based on the human expert's judgment, as though the human expert was present and observed the player's move.

Various embodiments provide tremendous advantage for mobile users, as they do not require the typical lengthy attention-span that a poker game requires for adequate study of the opponents and their playing style. In a typical poker game, during most of the play time the players are not fully engaged in the game. Rather, they decide to fold their hands before the flop, and the game continues with the other opponents (real or simulated). During that time, the player is expected to observe the game to detect patterns of behavior in the way the opponents play. Based on these patterns, the player may develop a play strategy directed at each opponent based on the opponent's unique style as reflected in his previous games. The observation process often requires just as much concentration and attention as a real play, because each opponent's decision should be analyzed in the context of the entire chain of actions throughout the hand. However, the observation process is far less enjoyable than actively playing, and many players find this process tedious and boring. This explains why many online poker players prefer to play multiple games simultaneously. This is exacerbated in a mobile scenario because of distractions. When playing on a mobile device, the player may be in motion and subjected to distractions, not to mention calls, emails or SMS messages that may come to the device while playing. Therefore, mobile users prefer short-attention span games, such as Angry Birds. However, various poker games achieved popularity on mobile devices, since they employ "play" money, such that losing games is of no real consequence to the players, as it would be if playing with "real" money.

One feature of various embodiments of the invention is that the observation process has been transformed and can be done in seconds. Consequently, virtually all of the game time is spent actively playing and thinking about game strategy, taking the opponents character into consideration, even though no time was spent learning their character. Instead, each opponent has a profile that was authored by the human expert. The player can see the highlights of the opponent's profile indicated by a graphic symbol on the play table, or can click on it to receive more detailed information about the specific patterns of the opponent's game style. Thus, the player can make analytical decisions based on the opponents' character or profile, without having to spend time observing them play and learning their character.

According to one embodiment, an authoring tool is provided, enabling experts to author various plays. The plays can then be played by users, according to the parameters specified by the expert. For each round of the play, the expert ranks each possible move that the user may make. Then, when the user actually makes the move, the user is graded according to the grading prepared beforehand by the expert, separately from the wining/losing of chips. Additionally, the user can be given a feedback and explanation as to why the move is bad and why a different move would have improved his chances of prevailing. The user is thereby encouraged to focus on rewards based on his decisions rather than focus on winning chips. This encourages proper decision making in future games.

Disclosed embodiments address a key challenge, which is the process of authoring or crafting the various scenarios. This is a process that can be only partially automated and requires interaction with a human expert, especially if opponents' character (e.g., playing style) is to be considered. During the authoring process, the human expert judgment is captured for every possible decision that eventually may be made by the player. During the game, each player's decision creates a new sub-scenario. There can be numerous cycles of decision making in a single hand played, and therefore the number of combinations explodes exponentially and becomes very difficult to manage. For any non-trivial game, the task of authoring the various scenarios and scoring each player's choice becomes very difficult task. Therefore, according to various embodiments, this process, called Scenario Authoring, is simplified. According to such embodiments, specific methods are provided to enable a human expert to author, review and edit the various scenarios. These embodiments make Scenario Authoring practical and economical, by placing limits on certain parameters, such as the number of play choices available to the player, without diminishing the educational value of the expert's authoring.

According to one specific example, the player's choices are limited and are classified into four categories:

- Bad Move: an obviously bad choice, indicating lack of attention or a player who is not at the skill level assumed by the specific scenario;
- Fair Move: a choice a reasonable player may make but inferior to what the expert suggests;
- Good Move: A move an expert may make but not necessarily the best move according to the author's judgment. Often, professional poker players may not agree about what the best move is. A Good Move is a move that can be rationalized by an expert.
- Best Move: The best choice with slight preference to the "Good" move.

In this example, in order to reduce the number of branches in the tree of possibilities, derivative scenarios are authored only in one case, most often in the case of "Best Choice." Accordingly, when the user makes a move, the game scores the selected choice, discloses the best choice, and continues with the "Best Move" scenario, regardless of the choice of the user. In rare cases, the author may wish to demonstrate some poker strategy principles and allow the user to proceed in selection other than the Best Move. In one embodiment, in the case of a user not selecting the branch in which the game is authored to continue (most often Best Move), the game scores the choice, discloses the best choice, and continues with the authored scenario. According to another embodiment, in case the user selects any other option but the Best Move, the game scores the choice, does not disclose the best choice, and enables the user to try again. But in all cases the game always continues in only one path. This limited options approach reduces the number of scenarios the expert needs to deal with and helps him focus on the scenarios occurring most often and those with instructional value.

According to some embodiments, the author can specify that during a specific round the game moves forward to the next step by forcing a move without giving the user any options to choose from. For example, in some rounds there may be only one rather obvious move that any player, even the most novice, would immediately recognize. In such a case, there's really no educational value to get the user's move selection. Therefore, the author may "enter" the selection for the user and the game would proceed according to that specified selection. In that case, the user has no opportunity to earn any points but the game can rapidly move to the next cycle.

In the embodiments where the game proceeds according to the best choice, regardless of the user's selection, the distribution of chips, i.e., the winning/losing of chips, should also progress according to the best choice, as this would be the only path of the game. Consequently, the movement of chips proceeds in the authored path regardless of the user's moves. That is, the movement of chips is pre-programmed by the author of the hand and the user has no control over it. This creates certain features that cannot be implemented in standard games. First, each new hand can start with different stacks, regardless of what happens in the just completed hand. This freedom allows the author to program each hand with different stacks, aimed at making a certain point or teaching certain technique. Second, since the chips are not accumulated over the hands, the user has no interest in following his stack (since he has no control over it), but rather instead is made to focus on the scoring of his action choices, thereby improving his skills. That is, while the user makes his selection with the goal of winning the hand, the user is actually scored based on the quality of his selected moves, not on his hand wins.

When the human expert authors a scenario, he needs to have a mental model of how the hand progresses through the different cycle of betting, folding, and raising through the pre-flop, flop, turn and river stages. The expert may want to refine his judgment and needs powerful methods to do so. During the authoring process the expert determines the opponents' profiles, the table image of the player (e.g., who sits where), the initial stack of chips, and the move of each opponent during the play. To enable the expert to perform this complicated task, embodiments of the invention encompasses a method that includes a Graphic Engine, a Game Simulator and a List Editor described below.

According to disclosed embodiments, the integration of the Graphical Engine and Game Simulator enables the author to create the hand with a graphical representation that shows him exactly how the game progresses based on his authoring. As the author specifies an action for a virtual opponent in the game, the graphical user interface actually executes the move on the screen. When the author specifies the flop, turn and river, the cards show up on the screen as thought the game is taking place. The integration of the graphical user interface and the authoring enables a unique authoring experience. It enables authors to create hands on-the-fly or from memory very rapidly.

The various aspects and features of the invention will now be described with reference to figures that illustrate examples of the operation of various embodiments of the invention.

FIG. 1 illustrates major conceptual components of an embodiment of the invention. In FIG. 1, Scenario DB is the database collection of the different scenarios, hands, descriptions, commentary, etc., that the human expert has entered into the system and that are available for the player as play scenarios. Played Games DB is a database that includes data about how a player has played, his scores and his status in certain hands, should he want to continue a hand or a Hand Pack that he has quit playing. The Played Games DB also includes various scores, administration, and configuration data about the player's preferences, and possibly about other players with whom the player wish to compete.

The Scenario Authoring component is used by the expert to author scenarios and hands. It uses both the Game Engine and the Graphic Engine to help the expert to graphically understand the game and how the user may experience the authored scenarios. According to one embodiment, the scenario authoring component presents the expert with a limited number of predefined parameters that the expert can select to craft a play scenario. For example, the scenario authoring component may present the expert with a list of possible opponents, each with predefined profile. According to one embodiment, the expert is also provided with the option to enter comments about each selected opponents, giving the player further information specific to the scenario and/or the expert authoring this scenario.

During the authoring process, at each step the author indicates a limited number of possible actions each player, i.e., virtual opponents and the user, may take. When selecting the possible actions for the user, the expert also ranks each action as being, e.g., inappropriate, rational, but not that good, or preferred action. The author also indicates a score attached to each possible play which, in this disclosure will be referred to as ProCoins. For example, inappropriate action may get zero ProCoins, rational action may get 1ProCoin, while two possible preferred actions may get 2 and 3ProCoins. For each of the user's selected actions, the author may enter explanation and analysis notes. During the actual play of the game, the user collects ProCoins according to actions he takes, separately of the chips the user may win or lose at each hand. That is, the chips are awarded according to the user's winning or losing a hand, while ProCoins are awarded at each step according to the expert's evaluation of the soundness of the play. Additionally, as the user selects an action for the available choice, the corresponding note authored by the expert is displayed for the user's edification.

The Game Engine component manages the interaction of the player using the game. The Graphic Engine can generate graphics based on the various data structures in the game and simulate a live poker game.

Figure 2:
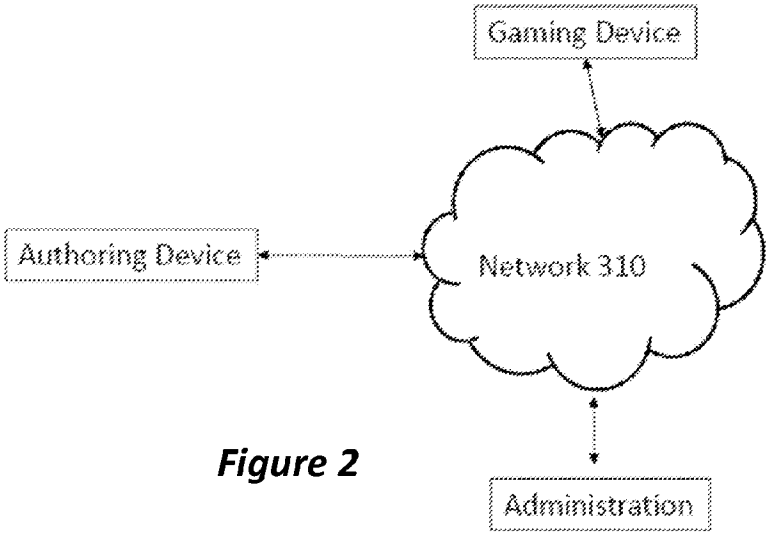
FIG. 2 illustrates one example of an operating environment and network in which embodiments of the invention can be implemented.

FIG. 2 illustrates one example of an operating environment and network in which embodiments of the invention can be implemented. In general, the invention can be used in any computing or communication network in which data regarding the games described herein can be presented to a player. These include local area networks, wide area networks, the Internet, mobile phone networks, etc. The invention can also be implemented in stand-alone mobile or computing devices. Notably, embodiments of the invention may be implemented as computing instruction sets stored in a computing memory, e.g., smartphones, pads, tablets, etc., to direct the computing device to perform the tasks of the game.

In FIG. 2, Gaming Device uses a network to access, asynchronously or synchronously if so desired, scenarios to be loaded to the gaming device, permissions and payment information from the administration component and information from other gaming devices. According to one embodiment, the user may download the game onto a computing device, such as smartphone, tablet, etc. The user may then download collections of hands and plays crafted by experts, referred to herein as Hand-Packs. Hand-Packs can be categorized according to authors, according to play level, according to strategies, etc. Each Hand-Pack may have a respective price. Additionally, according to certain embodiments, specific Hand-Packs may also require that the user has achieved a certain level of sophistication in order to purchase the Hand-Pack. This is done in order to ensure that the user get the most benefit out of that specific Hand-Pack. The way in which the level of sophistication is ascertained is according to the ProCoins the user has accumulated.

The Authoring Device uses the network to have access to Scenario DBs for storage or editing. It also uses the network to access the Administration Component for various purposes. The authoring device may be any computing device, such as smartphones, tablets, pads, etc. The Administration Component uses the network to control access to gaming and authoring devices and to manage use privileges for both experts and players.

Figure 3:
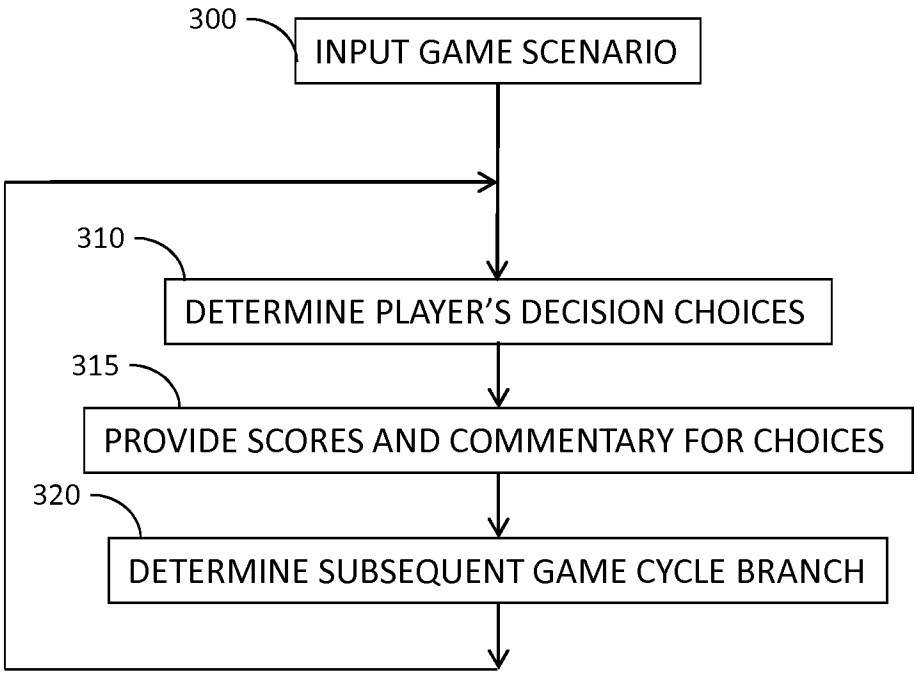
FIG. 3 shows an example of the workflow associated with the authoring of a scenario by a human expert.

FIG. 3 shows an example of the workflow associated with the authoring of a scenario by a human expert. As described herein, the scenarios present interesting and informative gaming situations that provide opportunities for learning and enjoyment. The author may author a single game, or author a collection of games arranged in a Hand-Pack as described herein. The author may also select an already authored game and edit the game.

As illustrated in FIG. 3, the author starts at step 300 by entering a game scenario. As part of the scenario, the author selects opponents and ascribes character/traits to each opponent. The opponents and character/traits are selected from a database of pre-programmed opponents and traits. Additionally, the author may enter specific notes about each opponent to augment the information provided by the database. The author may also enter information about how the virtual opponents view the user. At step 310 the author selects a limited number of actions from a database of possible actions for the virtual opponents and for the user. For example, suppose two opponents should act before the user, the author may specify that these two opponents fold their cards and then the author provides the user with four possible actions: Fold, Check, Raise to 7, Raise to 50. One of these actions would be clearly wrong, one would be rational, but not that good, and two would be proper, but one of them may be superior. At step 315 the author ascribes score (e.g., ProCoins) for each action and may also provide commentary explaining the merit or lack thereof for each action. At Step 320 the author selects the next game cycle in which he specifies action to other opponents and provide a new set of options for the user.

Figure 4:
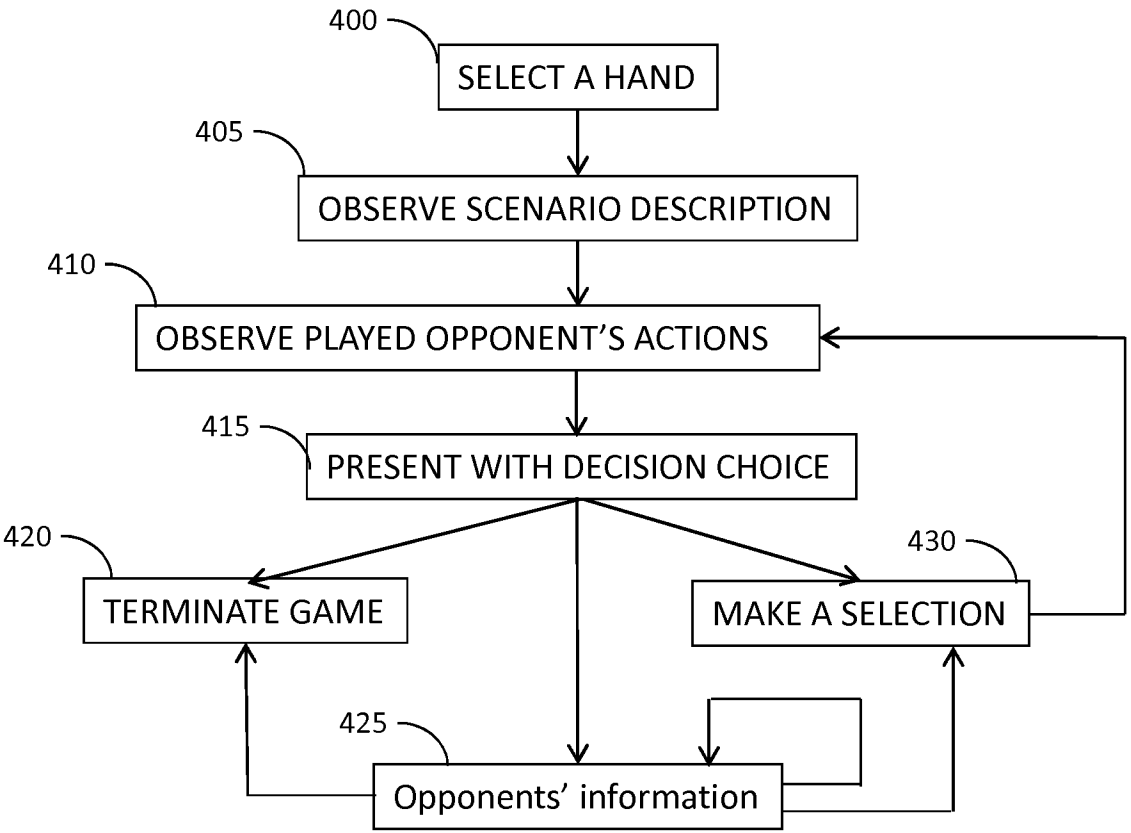
FIG. 4 illustrates an example of the workflow of a player playing the game.

FIG. 4 illustrates an example of the workflow of a player playing the game. At step 400 the user either selects a hand to play or is presented a hand out of a Hand-Pack he is playing. At step 405 the user is presented with information about the scenario, including information about the various opponents and the stacks. At step 410 the game performs the opponents' actions and at step 415 the user is presented with a limited number of actions as programmed by the author. At this point the user may terminate the game, step 420, review opponents' information 425, or take an action by selecting one of the options, step 430. As illustrated in FIG. 4, after reviewing the opponent's information in step 425, the user may elect to terminate the game, or proceed to step 430 to make a selection. Once a selection is made at step 430, the user is awarded ProCoins according to the program set by the author of this hand. The user is also presented with commentary about the merit or demerit of various moves. The game then proceeds to step 410 to play the next step, i.e., either have one or more opponents react to the user's choice, or go to the next step of the game, i.e., Flop, Turn, or River. As noted above, according to various embodiments, the game proceeds to the next step using the move deemed best by the author of the hand, regardless of the move selected by the user. Correspondingly, the number of chips added to the pot by the user (if any) is performed according to the best action pre-programmed by the author and not by the decision of the user.

Figure 5:
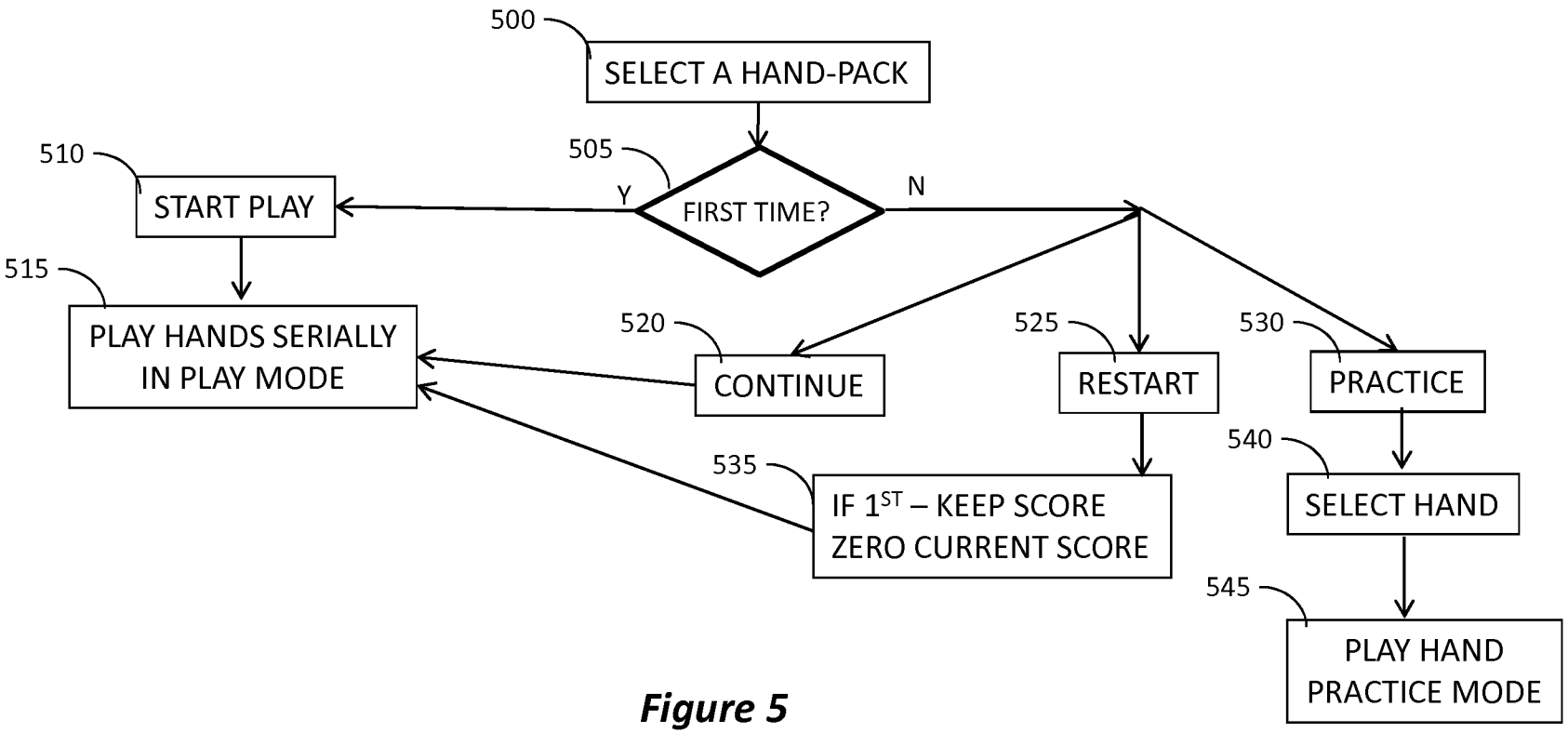
FIG. 5 illustrates another embodiment of work flow of a player playing the game.

FIG. 5 illustrates another embodiment of work flow of a player playing the game. In this embodiment, when a user starts the game, the user is presented with game packages, referred to as Hand-Packs. Each Hand-Pack may be a collection of hands authored by one expert, a collection of hands authored to teach a specific aspect or technique, etc. According to this embodiment, all of the hands in the game are grouped within the Hand-Packs, although in other embodiments other hands may be available loosely, i.e., not within a Hand-Pack. Therefore, the first step the user takes is to select a Hand-Pack in step 500. The system then proceeds to step 505 wherein it checks whether it is the first time that the user selected this Hand-Pack and, if so, it proceeds to start the first hand in that Hand-Pack, in step 510. As indicated by block 515, the hands within the selected Hand-Pack are played serially in "play" mode, meaning the user wins/loses chips and is also awarded and accumulated ProCoins for proper moves.

According to a feature of the invention, the wins/loses of chips are not accumulated nor tracked over the various hands the user plays. That is, at each new hand all of the stacks are set anew, regardless of the stacks' condition at the end of the previous hand. This approach has certain advantages. For example, this makes the winning/losing of chips irrelevant, and focuses the user on collecting ProCoins, so that the user is focused on learning good skills, rather than on winning chips. Also, this enables the author to set up different instructional scenarios, and have each scenario set up with chip distribution beneficial for learning certain strategies—irrespective of prior hands played by the user.

It should be noted at this point that in some implementations the user must purchase Hand-Packs. In such embodiments, when it is determined that the user selected a Hand-Pack for the first time; the system executes a purchasing process to acquire the Hand-Pack for the user. This may be a simple process such as iTune App-Store and need not be fully described herein. Therefore, for clarity, the purchasing process is not depicted in FIG. 5. Also, the process illustrated in FIG. 5 may be implemented in embodiments wherein the user does not need to purchase each independent Hand-Pack, e.g., all of the Hand-Pack are provided for free download or the Hand-Pack is purchased using ProCoins, based on the amount of ProCoins available by aggregating all Best Scores from all played Hand Packs.

If at step 505 it is determined that this is not the first time that the user started this Hand-Pack, the user can be presented with three options: continue (step 520), restart (step 525), or practice (step 530). These options can be provided as icons on the screen. If the user selects "continue", the game proceeds to play the hands serially in play mode, as in step 515. If the user selects "restart," the system checks whether it is the first time the user played this Hand-Pack and, if so, it stores the user's score as First Score, and then zeros the score. It then proceeds to play the hands serially, as in step 515. If the user selects "practice," the system presents the user with the hands within the Hand-Pack that already have been played and allows the user to select a hand in step 540. Hands that have not been previously played in game mode cannot be accessed in practice mode. In step 545 the user may play the hand in "practice" mode, meaning the user does not collect ProCoins and the user's score is not updated. When the user plays in "practice" mode, the game enables the user to try various selections, in case he has not selected the best choice, so as to re-enforce learning.

Figure 6:
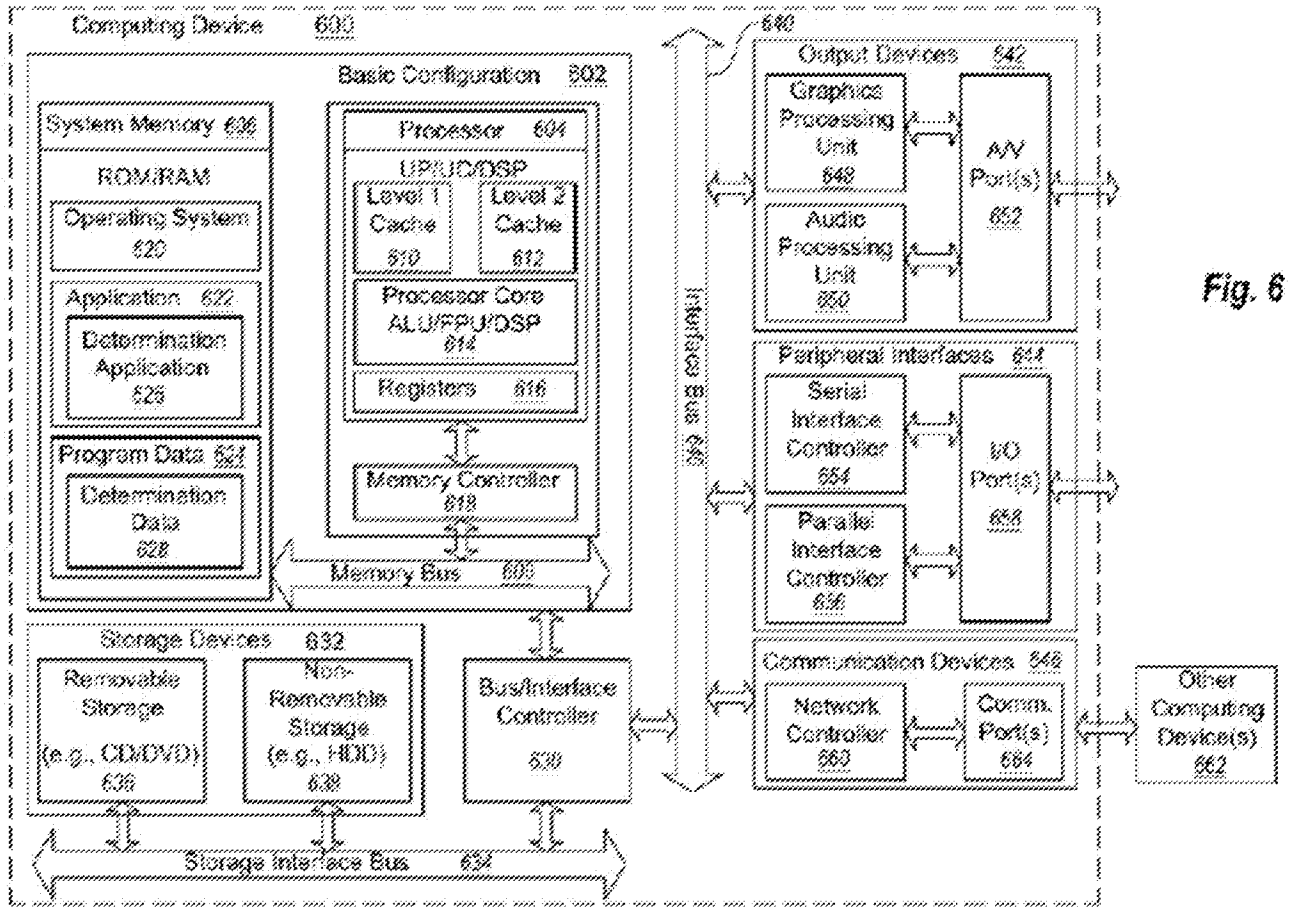
FIG. 6 shows an example computing device that can be used to implement the invention.

FIG. 6 shows an example computing device 600 that can be used to implement the invention. Although a specific example of a computing device is illustrated, it is emphasized that the invention can be performed in any of a variety of operating environments, and that FIG. 6 is presented for illustration purposes only.

Computing device 600 may be implemented as a portion of a small-form factor portable (or mobile) electronic device such as a cell phone, a personal data assistant (PDA), a personal media player device, a tablet or pad, such as iPad or Android-based pad, a wireless web-watch device, a personal headset device, an application specific device, or a hybrid device that include any of the above functions. Computing device 600 may also be implemented as a personal computer including both laptop computer and non-laptop computer configurations. The computing device 600 can also be any type of network computing device. The computing device 600 can also be an automated system as described herein.

In FIG. 6, computing device 600 is arranged to perform any of the authoring, gaming or computing methods described herein. In a very basic configuration 602, computing device 600 generally includes one or more processors 604 and a system memory 606. A memory bus 608 may be used for communicating between processor 604 and system memory 606.

Depending on the desired configuration, processor 604 may be of any type including but not limited to a microprocessor (μP), a microcontroller (μC), a digital signal processor (DSP), or any combination thereof. Processor 604 may include one more levels of caching, such as a level one cache 610 and a level two cache 612, a processor core 614, and registers 616. An example processor core 614 may include an arithmetic logic unit (ALU), a floating point unit (FPU), a digital signal processing core (DSP Core), or any combination thereof. An example memory controller 618 may also be used with processor 604, or in some implementations memory controller 618 may be an internal part of processor 604.

Depending on the desired configuration, system memory 606 may be of any type including but not limited to volatile memory (such as RAM), non-volatile memory (such as ROM, flash memory, etc.) or any combination thereof. System memory 606 may include an operating system 620, one or more applications 622, and program data 624. Application 622 may include a determination application 626 that is arranged to perform the functions as described herein including those described with respect to methods described herein. In some embodiments, application 622 may be arranged to operate with program data 624 on operating system 620.

Computing device 600 may have additional features or functionality, and additional interfaces to facilitate communications between basic configuration 602 and any required devices and interfaces. For example, a bus/interface controller 630 may be used to facilitate communications between basic configuration 602 and one or more data storage devices 632 via a storage interface bus 634. Data storage devices 632 may be removable storage devices 636, non-removable storage devices 638, or a combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Example computer storage media may include volatile and nonvolatile, removable and non-removable media implemented in any method or technology for storage of information, such as computer readable instructions, data structures, program modules, or other data.

System memory 606, removable storage devices 636 and non-removable storage devices 638 are examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which may be used to store the desired information and which may be accessed by computing device 600. Any such computer storage media may be part of computing device 600.

Computing device 600 may also include an interface bus 640 for facilitating communication from various interface devices (e.g., output devices 642, peripheral interfaces 644, and communication devices 646) to basic configuration 602 via bus/interface controller 630. Example output devices 642 include a graphics processing unit 648 and an audio processing unit 650, which may be configured to communicate to various external devices such as a display or speakers via one or more A/V ports 652. Example peripheral interfaces 644 include a serial interface controller 654 or a parallel interface controller 656, which may be configured to communicate with external devices such as input devices (e.g., keyboard, mouse, pen, voice input device, touch input device, etc.) or other peripheral devices (e.g., printer, scanner, etc.) via one or more I/O ports 658. An example communication device 646 includes a network controller 660, which may be arranged to facilitate communications with one or more other computing devices 662 over a network communication link via one or more communication ports 664.

The network communication link may be one example of a communication media. Communication media may generally be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

The embodiments described herein may include the use of a special purpose or general-purpose computer including various computer hardware or software modules.

Embodiments within the scope of the present invention also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures and which can be accessed by a general purpose or special purpose computer. When information is transferred or provided over a network or another communications connection (either hardwired, wireless, or a combination of hardwired or wireless) to a computer, the computer properly views the connection as a computer-readable medium. Thus, any such connection is properly termed a computer-readable medium. For example, downloadable "apps", such as iOS and Android apps can be properly viewed as a computer-readable medium. Combinations of the above should also be included within the scope of computer-readable media.

Computer-executable instructions comprise, for example, instructions and data which cause a general purpose computer, special purpose computer, or special purpose processing device to perform a certain function or group of functions. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

Specific Examples

The following are specific examples of embodiments that relate to implementation of a poker game in a mobile device, such as iPhone, iPad, Android-phone, etc. These are provided as examples for further clarity, but other implementations may be used.

Figure 7A:
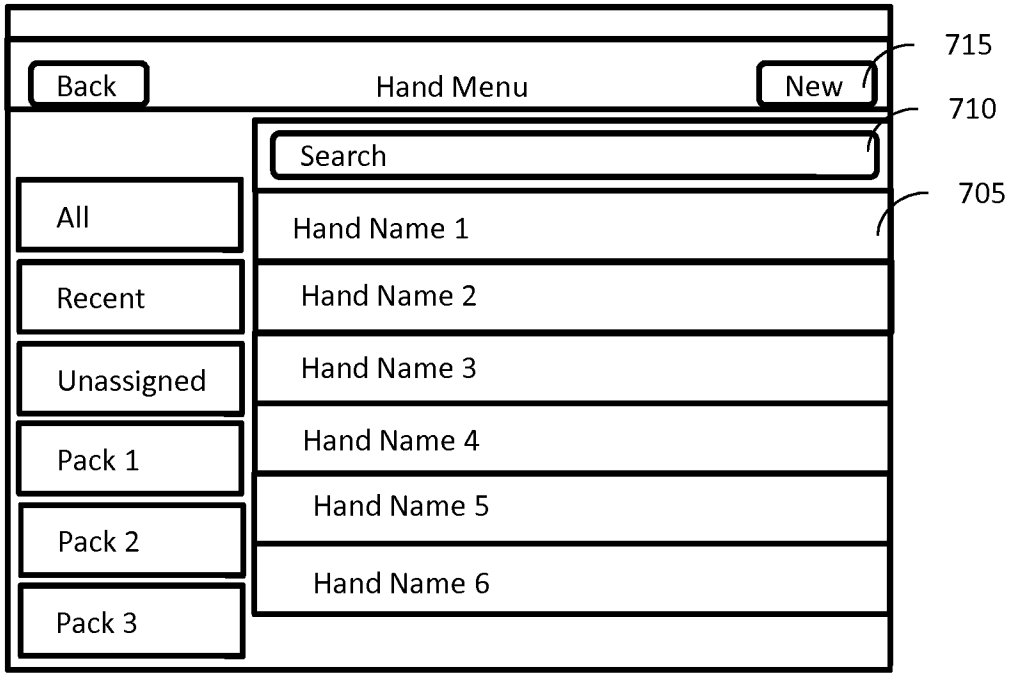

As explained above, FIG. 3 illustrates an example of a process flow for authoring hands. More specific example will now be provided for this process. FIG. 7A illustrates a screenshot of an authoring tool, enabling an expert to author, edit, and test hands. As shown in FIG. 7A, the author is provided with a scroll 705 of a list of all authored hands, each having a hand name. The hands that are displayed in the scroll can be filtered for ease of management by the author, by clicking on the "all", "recent", "unassigned", "pack 1" etc. The "packs" are collections of hand authored by the author and grouped into packs by the author, having no relationship to HandPacks, which are collections of hands provided for the user. The author may select any hand from the list for edit. The author may also search for specific hands using the search menu 710. The author may also start authoring a new hand by clicking on the "new" icon 715.

Figure 7B:
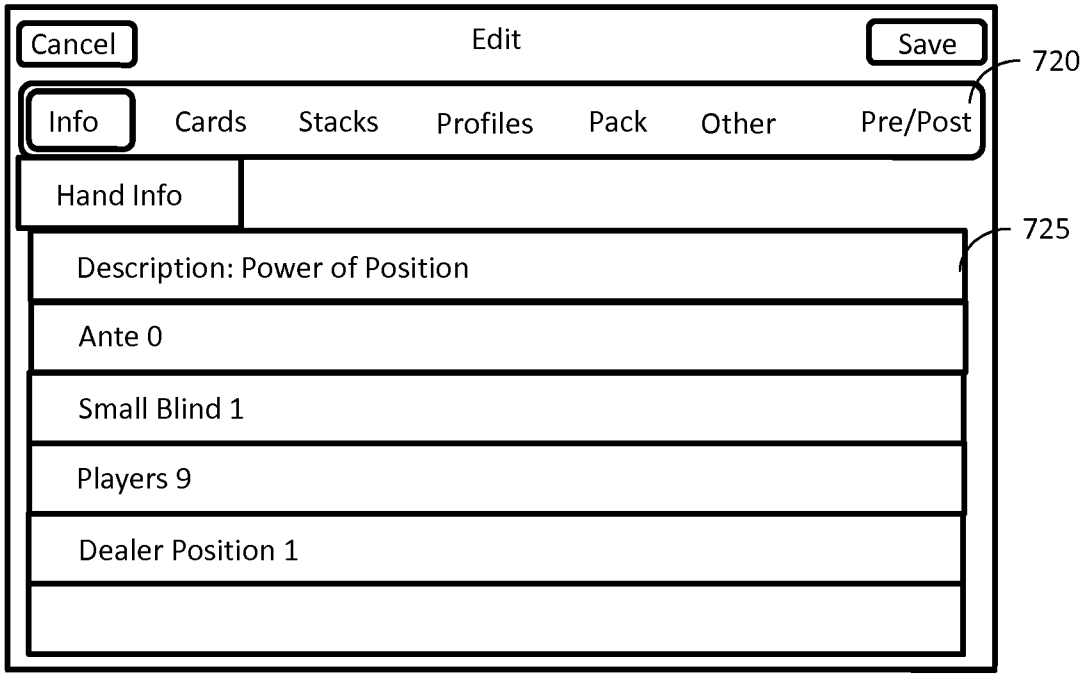
FIG. 7B illustrates an example of a screenshot providing various options for programming a hand.

As noted with respect to FIG. 3, when the author starts to author a new hand, such as by clicking on "new" icon 715 in FIG. 7A, the author is presented with a new screen, having various options for programming a hand. An example of such a screen is illustrated in FIG. 7B. As shown in FIG. 7B, a dropdown menu 720 enables the author to select and edit various aspect of the authored hand.

In general, the hand scenario includes a prelude to the game, that is, the text to be displayed to the user just before the hand is presented to him e.g., "game is at the third level just before the break and the table has been very passive". Such information provides the user with a game experience as if the user has been playing at this table for a while. The hand scenario also includes the number of opponents, the position of the user, profiles of the different opponents and the table image, the blinds and ante, the stacks each component has, assign cards to the user and to various opponents, etc.

In the screenshot of FIG. 7B the author has selected "info" from the dropdown menu. This opens a menu 725 of options for authoring general information about the hand. For example, the author can give the hand a name, decides how many players participate, decide where the player and where the dealer are positioned, etc. Once selecting the players, the author may use the "Cards" dropdown menu to determine which cards each of the opponents and the player have.

A beneficial feature of this embodiment is the "Profile" menu. By selecting the "profile" menu the author is provided with a list of pre-programmed profiles of players. The author can select and assign profiles to each of the opponents. Additionally, the author may also add his own comments about each opponent. During the play, the user can access this information and be informed about the character of each player, without having to observe and study them for an elongated period. Another beneficial feature of this embodiment is that the author can assign a profile and include notes about the opponents or the user. Of course, the author does not know the user and the user's character; however, the selection of a profile indicates what the opponents think about the user. This helps the user devise strategies by taking into account the way the opponents view the user.

The author then programs the actions of the opponents. The user is a special player who has a will of his own. However, to make the tree of possibilities manageable and educational, the author specifies a limited number of possible moves from which the user may select. According to this embodiment, the authoring tool provides the author with a multitude of possible moves from which the author may select a limited number. For example, the authoring tool may provide the author with a selection of "raise" and then provide a scroll for the author to set the amount of the raise. For every potential move selected for the user, the author determines the score of the move (e.g., number of ProCoins), and indicates whether the move is BAD, FAIR, GOOD or BEST move. The author also enters a comment to be displayed for the user if he selects a specific move. The author also has a field called ANALYSIS where he enters a complete analysis of this particular decision to be displayed regardless of the move selected.

According to one embodiment, most of the time the game continues with the BEST choice regardless of what the user selects. However, to demonstrate strategy principles, the author may specify that the game will continue with a certain move which is not necessarily the best. The author also specifies the cards that show up on the flop, turn and river, together with each opponents' corresponding actions and the user's moves options. Of course, since the game proceeds according to the author's programming, the author also programs how the stacks change at each round according to the move selected by the author and regardless of the moves of the user.

In the disclosed embodiments, one of the game's objectives is to train users to focus their attention on making quality decisions and controlling the greed and fear emotions related to losing/gaining chips. Accordingly, a scoring system is established in addition to the wining/losing of chips. In fact, the winning/losing of chips may be ignored altogether and set anew at each hand played. In this description the scoring is explained with reference to one exampled called ProCoins, but other scoring can be implemented. Under such a system, the stacks can progress according to winning/losing of games or game steps, while the scoring progresses according to the quality of decisions made by the users. That is, only the scoring (in the form of ProCoins) is maintained, and the winning/losing of chips is discarded after each hand is played, with a new distribution of chips authored for the next hand—without any relationship to the amount of chips each opponent and the user had in the previous hand. Accordingly, the winning/losing of chips has no impact on scores and thereby, the amount of ProCoins earned. Consequently, the primary incentive is to earn ProCoins, not to win chips. Moreover, as noted above, in some embodiments the rounds of a hand progress according to the best moves, not necessarily according to the user's choices. Consequently, the corresponding winning/losing of chips is controlled according to the author's selection of best moves, not according to the user's moves. Therefore, the game trains the user to focus on making correct decisions, regardless of whether those decisions lead to winning or losing a game or a hand.

Using the scoring system as applied specifically to the poker example described herein, the user's moves are scored based on the merit or quality of a decision or a move taken as the hand is played. As noted previously, the hand's author specifies beforehand several possible moves for the user to select at each round, and each move has a corresponding score. When a user selects a move, he gets the corresponding score and, in this specific example, earns virtual currency called ProCoins, that correspond to the move's score. In a single hand, a user may face several decision points as the hand progresses through the rounds and accumulates total score for the hand and accumulate total score for the Hand-Pack. The total score for a hand corresponds to how well the hand was played. There is no connection between the chips won/loss and ProCoins or scores earned for the hand. To help users focus on making good decisions, earing high scores and accumulating ProCoins, the game may include various animations and sound effects to reward quality decisions. This is fundamentally different from other poker games where users are rewarded by gaining chips regardless of how well they played.

According to one example, the user's earned ProCoins are accumulated and managed by the game. Users can monitor how many ProCoins they earned in each hand, in each Hand-Pack and the total they have earned playing multiple Hand-Packs. The game accounts six types of ProCoins used for different purposes, as follows.

Hand-Pack First Score: This is the total ProCoins earned playing a Hand-Pack for the first time. Since users can replay a Hand-Pack after they have the opportunity to observe and learned the best moves, a user can eventually play a Hand-Pack earning maximum score. One the game's objective is for a group of users to compete and to see how well they play comparatively to each other. To level the playing field, the users will use the Hand-Pack First Score as the indicator. This score will not change regardless of how many times the player plays the corresponding Hand-Pack.

Hand-Pack Current Score: This is the total ProCoins earned most recently playing the Hand-Pack. For example, a user may play a Hand-Pack for the first time and earns total of 140 ProCoins. He may select to replay the Hand-Pack. When he clicks the Replay button, the Hand-Pack First Score is saved and the Hand-Pack is replayed from the beginning, starting with a "Hand-Pack Current Score" of 0. As the user progresses through the Hand-Pack, he is earning ProCoins and the total ProCoins he has earned playing this time is the "Hand-Pack Current Score". However, the Hand-Pack First Score does not change.

Hand-Pack Best Score: For a variety of reasons a user may not play as well as he has played before, and his "Hand-Pack Current Score" might be lower than a previous score. The game always keeps the best score for each Hand-Pack. So users cannot do any worse. According to one embodiment, the Hand-Pack Best Score is the number of ProCoins users can redeem for various rewards, such as advanced Hand-Packs. The Hand-Pack Best Score can also be used as a filter, enabling the system to offer the user Hand-Packs that are appropriate for the skill level of the user.

ProCoins Available: This is the total of Hand-Pack Best Score accumulated across all Hand-Packs played by the user minus ProCoins that already have been used to redeem rewards. Users are incentivized to play more Hand-Packs and to make more quality decisions to increase their ProCoins Available.

Life Time ProCoins: This is the total number of ProCoins accumulated across all Hand-Pack Best Score for all played Hand-Packs.

Hand-Pack Maximum Score: This is the total number of ProCoins a user can earn perfectly playing a Hand-Pack To incentivize the user to select the best moves, the user can get certain privileges, such as redeeming ProCoins for various rewards. For example, the user can use ProCoins as a virtual currency to buy additional Hand-Packs. According to another embodiment, users are also able to redeem either "Available ProCoins" or "Hand-Pack Best Score" for certain services, such as subscription to additional content or off-game services. For example, an author can offer web-subscription service for certain number of ProCoins earned in his Hand-Pack "Hand-Pack Best Score". ProCoins can also be used for access privileges to certain services or to online poker games or poker rooms.

The use of ProCoins can extend beyond the game itself. For example, various affiliate companies can present various offers based on "Hand-Pack Best Score" or "ProCoins Available". For example, an online casino can offer a coupon only to players who achieved certain threshold of ProCoins. The online casino partner may qualify his prospective players based on their play quality and suggest to them just the appropriate level of play on his online casino. Another example is a poker training affiliate offering training packages to qualified players based on their level of ProCoins.

The ProCoins can be used for marketing purposes for third parties. For example, the system may track ProCoins of various users, and when a user passes a threshold of accumulated ProCoins, the user may be presented by an offer from a third party as being qualified. For example, the user may be offered to join poker game with real players who are of the same skill level, as indicated by their accumulation of ProCoins. Similarly, the user may be presented with offers for Hand-Packs directly by authors, the Hand-Packs being tailored to the skill level achieved by the user, as indicated by his ProCoins.

As can be understood, the game has two objectives which are often conflicting. It aims at conveying complicated concepts and deep thoughts related to poker theory. At the same time, it aims at entertaining poker enthusiasts who are on the go and may prefer to just have fun and play poker, having learning as a side product of playing and having fun. At one time a user may be in a mood to learn deep strategies, while at other times may prefer to just take it easy and test his skills. To accomplish these two objectives the game has two modes: "play" mode and "Practice" mode. The selection of these modes is exemplified in FIG. 5, explained above.

In "Play" mode, when the user plays a Hand-Pack he may read the detailed explanations if he wishes, or he may just enjoy the game and test his skills ignoring the detailed comments, knowing that the explanations are there for him for review at a later time. In this mode of play, the user can rapidly play hand after hand trying to make the best decision and stopping to read the detailed comments only if it fits him.

During "Practice" mode, the user can select any hand from the Hand-Pack, as long as he already has played it in the "Play" mode. This is done so that the score, i.e., the ProCoins, are awarded according to the true skill of the user, without the benefit of hindsight, having practiced the hand and memorized the opponents' moves. In "Practice" mode the score for the hand is displayed and accumulated but it does not affect the Hand-Pack score. If the user selects a less than the best move, the system will offer him to try again (or to continue). The "Try-again" feature is a great "learning by discovery" method that is effective in re-enforcing the logic and helping the user to remember the hand's lesson.

Figure 8:
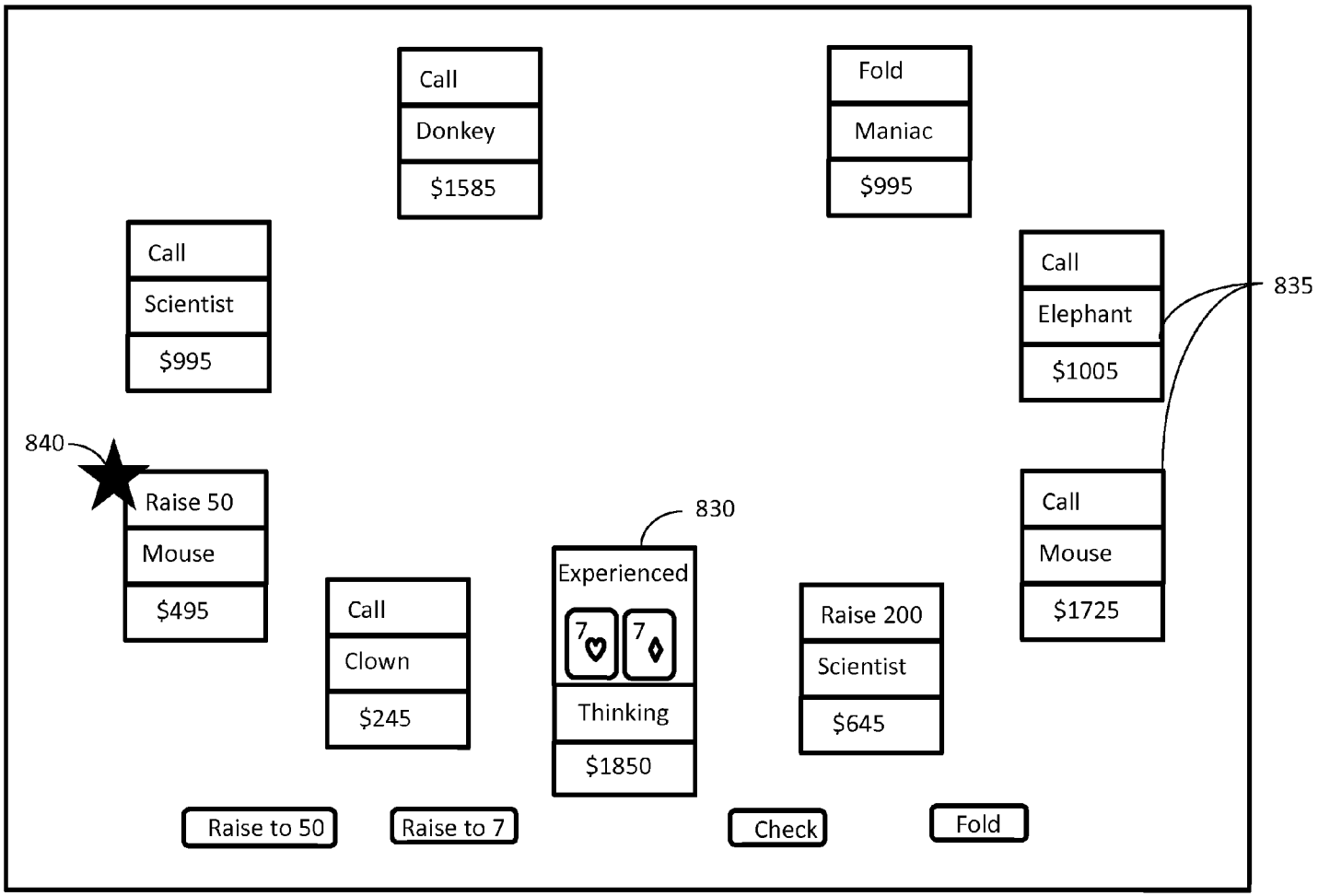
FIG. 8 illustrates an example of screenshot of a poker game implemented according to an embodiment of the invention.

FIG. 8 illustrates an example of screenshot of a poker game implemented according to an embodiment of the invention. This game is run by the Game Module, which presents games to the user, as was authored on the Authoring Module. The game module may be implemented as an app for mobile devices, such as iOS or Android based devices. The game module runs pre-programmed hands, which can be grouped under hand-packs that the user may download to the device.

In the example shown in FIG. 8, there are eight pre-programmed virtual opponents 835. Each virtual opponent is assigned character traits that are grouped under a name, e.g., elephant, scientist, mouse, etc. For example, "elephant" may indicate a player with good memory, "scientist" may indicate a calculated player, "mouse" may indicate a player who's afraid to gamble, etc. Moreover, an icon, such as star 840, may be provided for an opponent having trait critical for this specific hand or round. Also, each virtual opponent has a pre-programmed stack size. As the game progresses, the action of each virtual opponent is indicated, e.g., fold, call, raise, etc., and his stack changes accordingly.

The user, 830, is also pre-programmed with character traits, which are those traits that the virtual opponents believe the user to possess. This hones the user in taking advantage of the way he is viewed when playing with real opponents. The cards that the user was dealt for this hand are also displayed, together with the stack size the user is assigned for this hand. Notably, since the main goal of the game is to encourage proper decision making by awarding ProCoins, the opponents' and/or the user's stack can be different at each hand, regardless of the stacks at preceding games. This helps in setting educational scenarios and, since the winning/losing of chips is irrelevant in this game, resetting the stacks at each hand is of no consequence for the scoring of the game.

In the example depicted, it is the user's turn to take action, and the user may only select from limited number of pre-programmed options. In this example, the user is presented with four options: Fold, Check, Raise to 7, and Raise to 50. One of these options is clearly bad, one is fair, but not good, one is good, and one is preferred or best move. The author who pre-programmed this hand has assigned each of the options a score, e.g., number of ProCoins to be awarded, which are not visible to the user. Once the user makes a selection, the score is presented, together with an explanation as to why the move is good or not. In one embodiment, regardless of the choice of the user, the game progresses as if the user selected the best or preferred move, although the user is scored according to his actual selection. This limits the number of possibilities in the possibilities tree of the game, and focuses the user on learning how good choices advance the game.

Once the user completed the hand, he is presented with the next hand (if there are remaining hands in the Hand-Pack). The next hand may be, for example, a hand in the same table, but skipping some play time, so that the environment has changed, e.g., the game has been played for 5 hours already, so some losing opponents start making the action fast and loose. Since five hours have passed since the previous hand, the stacks have changed and may be shown differently than their status at the end of the last hand. This is clearly different from other prior art games, wherein the main score, e.g., the number of chips, is maintained and accumulated for the user over consecutive rounds.

Of course, the next hand can be of a totally different table and scenario. The hands in a Hand-Pack need not follow any certain order; however, they may be grouped so as to teach a certain concept, enhance certain learning, etc. Since illustrating certain concepts may entail setting up different stacks for the opponents and player, the concept of scoring according to decision making frees the authors of the hands to set up different stakes for each hand in the Hand-Pack.

Figure 9:
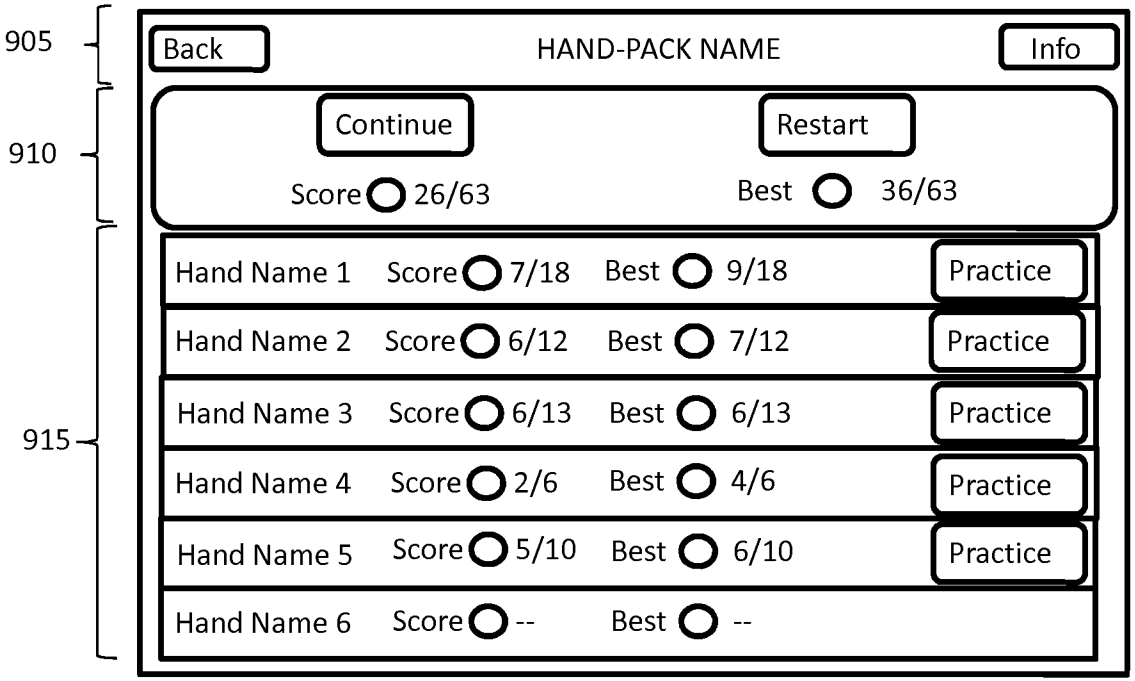
FIG. 9 illustrates a specific example of a screenshot for hand and play selection according to an embodiment of the invention.

FIG. 9 illustrates a specific example of a screenshot for hand and play selection according to an embodiment of the invention. In this embodiment, the screenshot of FIG. 9 is shown after the user selects a specific hand-pack. The screenshot is generally divided into three sections: title section 905, hand-pack section 910, and hands section 915. The title of the hand-pack is shown in the title section 905, together with "back" and "info" icons. Clicking the "back" icon takes the user back to the screen for selecting hand-packs. Clicking the "info" icon takes the user to a screen wherein an explanation of the hand is provided.

The hand-pack section 910 shows the user the current Pro-Coins score and the best ProCoins score the user has achieved for this specific hand. The hand-pack section 910 also has "continue" and "restart" icons. Clicking the "continue" icons takes the user to the hand where the user last left off this specific hand-pack. Clicking the "restart" icon, zeros the hand "score" (explained below) for all of the hands in this hand-pack and takes the user to the first hand to play all the hands serially.

The hands section 915 has all of the hands displayed serially. In FIG. 9 six hands are shown, numbered 1-6, but more can be included by scrolling down. In each hand, the hand name is displayed, together with the current score and the best score achieved for this hand. The "score" value shown in each hand is the score that is zeroed if the user clicks "restart" in the hand section 910. Also, in each hand that has already been played, thereby having a score and best values displayed, a "practice" icon is shown. When the user clicks on the "practice" icon, the specific hand selected is played in practice mode, as explained with respect to FIG. 5.

As shown in FIG. 9, hand 6 does not have score or best value, and does not have "practice" icon. This is because the user has never played hand 6. Therefore, the user never won any ProCoins for this hand. Also, the user is not given an option to play a hand in "practice" mode before the user plays the hand in "play" mode at least once.

The games that are designed and operate according to the invention can be physically embodied in any of a variety of gaming platforms that operate with various computing devices and networks.

While the invention has been described with reference to particular embodiments thereof, it is not limited to those embodiments. Specifically, various variations and modifications may be implemented by those of ordinary skill in the art without departing from the invention's spirit and scope, as defined by the appended claims.

The invention claimed is:

1. A computerized method for running a poker game, while enhancing a user's skill level at playing poker, wherein when executed the method causes a computerized device to perform the operations:

configure and operate progression of the poker game;

display the poker game on a monitor;

simulate opponents and actions of the opponents on the monitor;

display on the monitor a distribution of poker chips based on the user's winning or losing situation;

at each poker round, limit a number of play choices available to the user and a number of branches in a tree of possible player decisions, and present the user with a limited number of actions available at each decision round of the poker game;

perform scoring based on the user's selection from the limited number of actions available at each decision round of the game, separate and independent from the winning or losing situation; and, wherein the operation of simulating opponents comprises presenting the user with trait information about each simulated opponent, wherein the trait correlates to simulated decision making of the opponent.

2. The method of claim 1, wherein the operation of simulating the actions of the opponents is performed according to a list of actions pre-programmed by a human author.

3. The method of claim 1, wherein the scoring is performed according to a scoring level pre-programmed by a human author for each of the limited number of actions.

4. The method of claim 1, wherein the operation of simulating opponents further comprises presenting an icon on the monitor whenever a simulated opponent's trait is specifically relevant to the game round being played.

5. The method of claim 4, further comprising ascribing character trait to the user and presenting on the monitor an indication of the character trait of the user.

6. The method of claim 1, wherein the operation of simulating opponents actions of the opponents comprises fetching from storage memory pre-programmed opponents and pre-programmed actions of the opponents.

7. The method of claim 1, further comprising providing the user with privileges based upon the scoring.

8. The method of claim 7, wherein the privileges include access to further games.

9. A computerized method for running a poker game, while enhancing a user's skill level at playing poker, wherein when executed the method causes a computerized device to perform the operations:

configure and operate progression of the poker game;

display the poker game on a monitor;

simulate opponents and actions of the opponents on the monitor;

display a distribution of poker chips on the monitor based on the user's winning or losing situation;

at each poker round, limit a number of play choices available to the user and a number of branches in a tree of possible player decisions, and present the user with a limited number of actions available at each decision round of the poker game;

perform scoring based on the user's selection from the limited number of actions available at each decision round of the game, separate and independent from the winning or losing situation, wherein the distribution of poker chips and the user's winning or losing position is pre-programmed beforehand by a game author.

10. The method of claim 9, wherein at each round, the game proceeds according to actions pre-selected by an author of the game, regardless of the actions selected by the user.

11. The method of claim 1, wherein the scoring comprises award of redeemable coins different from the poker chips.

12. The method of clam 1, wherein for each of a pre-flop, a flop, a turn and a river stages of the poker game, one of the limited number of possible actions is pre-designated as best choice, and wherein the game proceeds according to the best choice, regardless of the selection of the user.

* * * * *